US006821124B2

(12) United States Patent
Healy et al.

(10) Patent No.: US 6,821,124 B2
(45) Date of Patent: Nov. 23, 2004

(54) LASER FREQUENCY MODULATION TACTICAL TRAINING SYSTEM

(76) Inventors: Fritz W. Healy, 6645 Towhee Ln., Carlsbad, CA (US) 92009; Himanshu N. Parikh, 5235 Caminito Exquisito, San Diego, CA (US) 92130

( * ) Notice: Subject to any disclaimer, the term of this patent is extended or adjusted under 35 U.S.C. 154(b) by 0 days.

(21) Appl. No.: 10/449,678

(22) Filed: May 30, 2003

(65) Prior Publication Data

US 2004/0029080 A1 Feb. 12, 2004

Related U.S. Application Data

(62) Division of application No. 09/744,453, filed as application No. PCT/US99/17817 on Aug. 3, 1999, now Pat. No. 6,638,070.

(60) Provisional application No. 60/095,616, filed on Aug. 7, 1998.

(51) Int. Cl.[7] ..... F41G 3/26

(52) U.S. Cl. ..... 434/22; 434/300; 434/11; 434/21

(58) Field of Search ..... 434/22, 300

(56) References Cited

U.S. PATENT DOCUMENTS

| | | | |
|---|---|---|---|
| 4,629,427 | A | 12/1986 | Gallagher |
| 4,662,845 | A | 5/1987 | Gallagher et al. |
| 4,682,953 | A | 7/1987 | Doerfel et al. |
| 4,695,058 | A | 9/1987 | Carter, III et al. |
| 4,817,633 | A | 4/1989 | McStravick et al. |
| 4,823,401 | A | 4/1989 | Gammarino et al. |
| 4,833,726 | A | 5/1989 | Shinoda et al. |
| 5,074,793 | A | 12/1991 | Hambric et al. |
| 5,228,854 | A | 7/1993 | Eldridge |
| 5,292,254 | A | 3/1994 | Miller et al. |
| 5,378,155 | A | 1/1995 | Eldridge |
| 5,382,958 | A | 1/1995 | FitzGerald |
| 5,426,295 | A | 6/1995 | Parikh et al. |
| 5,447,436 | A | 9/1995 | Campagnuolo et al. |
| 5,474,452 | A | 12/1995 | Campagnuolo |
| 5,571,018 | A | 11/1996 | FitzGerald |
| 5,788,500 | A | 8/1998 | Gerber |
| 5,818,344 | A | 10/1998 | Sharpe |
| 6,050,822 | A | 4/2000 | Faughn |
| 6,233,431 | B1 | 5/2001 | Panther et al. |

OTHER PUBLICATIONS

"Lasers to Keep GIs on target", Curran et al., Electronics, Jun. 23, 1977, pp. 96–97.

*Primary Examiner*—Jessica Harrison
*Assistant Examiner*—John Sotomayor
(74) *Attorney, Agent, or Firm*—Greer, Burns & Crain, Ltd.

(57) ABSTRACT

A laser based tactical engagement simulation training system, and in particular a MILES type system, is characterized by an improved communication code structure for the system. The improved code word structure comprises a standard MILES code word that is modified to contain information over and above that required to be embodied in a standard MILES code word. This is accomplished by FM modulating the logic level "1" pulses of the standard MILES code word in a manner that embeds additional information in the word and enhances the system, while at the same time maintaining downward compatibility with existing MILES systems. Apparatus also is provided for encoding, transmitting, receiving, decoding and processing information embodying the improved code structure, which significantly enhances tactical engagement simulation for direct fire force-on-force training and that yields more accurate simulation to improve tactical training results.

26 Claims, 11 Drawing Sheets

FREQUENCY MODULATED MILES PID CODE

| TIME SLOT | 0 | 1 | 2 | 3 | 4 | 5 | 6 | 7 | 8 | 9 | 10 |
|---|---|---|---|---|---|---|---|---|---|---|---|
| BIN 0 | 1 (ID) | 1 (X2) | | | 1 (X1) | | | | 1 (X0) | 1 (Y2) | 1 (Y1) |
| BIN 6 | 1 (Y0) | | 1 (Z2) | | | | | | | | |
| BIN 8 | | 1 (Z1) | | | | | | | | | 1 (Z0) |
| BIN 10 | | | | | | | | | | | |

(ID): FREQUENCY CODED DATA IDENTIFIER
(X2,X1,X0): SHOOTER OFFSET POSITION, X-AXIS (ECEF X, Y, Z COORDINATE SYSTEM)
(Y2, Y1, Y0): SHOOTER OFFSET POSITION, Y-AXIS (ECEF X, Y, Z COORDINATE SYSTEM)
(Z2, Z1, Z0): SHOOTER OFFSET POSITION, Z-AXIS (ECEF X, Y, Z COORDINATE SYSTEM)

*FIG. 3*

| Frequency | Value |
|---|---|
| 1.0 MHz | 0 |
| 666.67 kHz | 1 |
| 500 kHz | 2 |
| 400 kHz | 3 |
| 333.33 kHz | 4 |
| 285.71 kHz | 5 |
| 250 kHz | 6 |
| 222.22 kHz | 7 |
| 200 kHz | 8 |
| 181.82 kHz | 9 |
| 166.67 kHz | spare |
| 153.85 kHz | spare |
| 142.86 kHz | spare |
| 133.33 kHz | spare |
| 125 kHz | spare |

FIG. 4

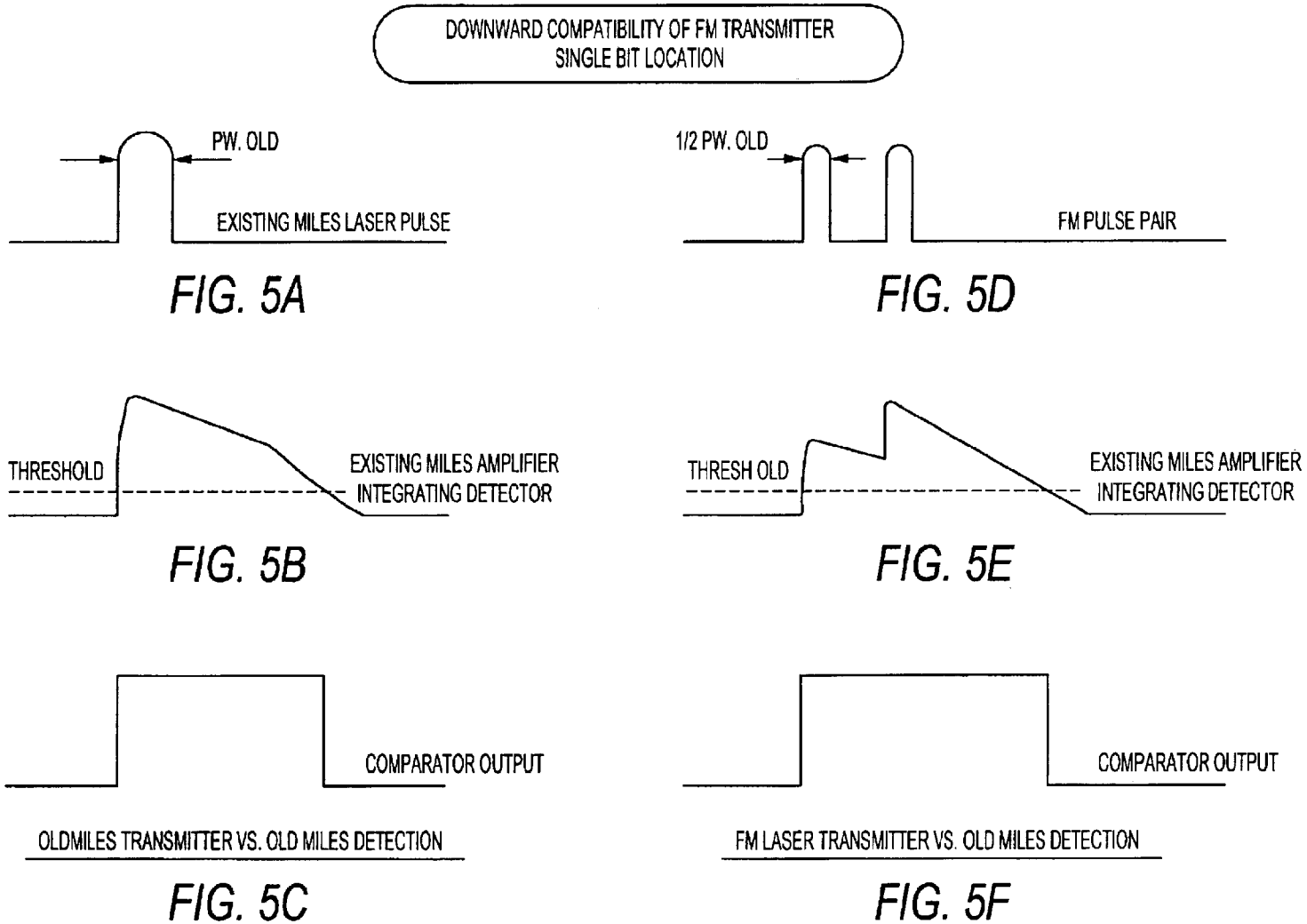
DOWNWARD COMPATIBILITY OF FM TRANSMITTER
SINGLE BIT LOCATION
PW. OLD
EXISTING MILES LASER PULSE
FIG. 5A
1/2 PW. OLD
FM PULSE PAIR
FIG. 5D
THRESHOLD
EXISTING MILES AMPLIFIER
INTEGRATING DETECTOR
FIG. 5B
THRESH OLD
EXISTING MILES AMPLIFIER
INTEGRATING DETECTOR
FIG. 5E
OLDMILES TRANSMITTER VS. OLD MILES DETECTION
COMPARATOR OUTPUT
FIG. 5C
FM LASER TRANSMITTER VS. OLD MILES DETECTION
COMPARATOR OUTPUT
FIG. 5F UPWARD COMPATIBILITY OF MILES TRANSMITTER
SINGLE BIT LOCATION
PW. OLD
EXISTING MILES LASER PULSE

THRESHOLD
FM AMPLIFIER

COMPARATOR OUTPUT
OLD MILES TRANSMITTER VS. FM DETECTION SYSTEM

1/2 PW. OLD
FM PULSE PAIR

THRESHOLD
FM AMPLIFIER

COMPARATOR OUTPUT
FM LASER TRANSMITTER VS. FM DETECTION SYSTEM

| MESSAGE | SAT | HELMET |
|---|---|---|
| HELLO | 1. TRANSMIT HELLO MESSAGE<br>2. TURN ON RECEIVER | 3. RECEIVE HELLO MESSAGE<br>4. TRANSMIT HELLO ACKNOWLEDGE MESSAGE<br>5. TRANSMIT OTHER MESSAGE(S) |
| BIT | 2. RECEIVE BUILT-IN-TEST REQUEST<br>3. PERFORM BUILT-IN-TEST AND TRANSMIT RESULTS | 1. TRANSMIT BUILT IN TEST REQUEST |
| KILL | 2. RECEIVE KILL MESSAGE<br>3. DISABLE SAT AND TRANSMIT KILL ACKNOWLEDGE MESSAGE | 1. TRANSMIT KILL MESSAGE |
| POSITION | 2. RECEIVE GPS POSITION MESSAGE<br>3. PROCESS GPS POSITION AND TRANSMIT POSITION ACKNOWLEDGE MESSAGE | 1. TRANSMIT GPS POSITION MESSAGE |
| ROUNDS | 2. RECEIVE REQUEST FOR NUMBER OF ROUNDS FIRED<br>3. TRANSMIT NUMBER OF ROUNDS FIRED SINCE LAST COMMUNICATION | 1. TRANSMIT REQUEST FOR NUMBER OF ROUNDS FIRED |
| OVER | 2. RECEIVE COMMUNICATIONS OVER MESSAGE<br>3. TURN OFF RECEIVER<br>4. TRANSMIT OVER ACKNOWLEDGE MESSAGE | 1. TRANSMIT COMMUNICATIONS OVER MESSAGE |

*FIG. 7B*

| BINARY 4-BIT VALUE (F3 F2 F1 F0) | ASSIGNED VALUE | SPACE BETWEEN PULSE (mSEC) |
|---|---|---|
| 1 1 1 1 | 0 | 1.0 |
| 1 1 1 0 | 1 | 1.5 |
| 1 1 0 1 | 2 | 2.0 |
| 1 1 0 0 | 3 | 2.5 |
| 1 0 1 1 | 4 | 3.0 |
| 1 0 1 0 | 5 | 3.5 |
| 1 0 0 1 | 6 | 4.0 |
| 1 0 0 0 | 7 | 4.5 |
| 0 1 1 1 | 8 | 5.0 |
| 0 1 1 0 | 9 | 5.5 |
| 0 1 0 1 | SPARE | 6.0 |
| 0 1 0 0 | SPARE | 6.5 |
| 0 0 1 1 | SPARE | 7.0 |
| 0 0 1 0 | SPARE | 7.5 |
| 0 0 0 1 | SPARE | 8.0 |
| 0 0 0 0 | SPARE | 8.5 |

FIG. 7C

| FREQUENCY COUNT | ASSIGNED VALUE |
|---|---|
| 8 - 12 | 0 |
| 13 - 17 | 1 |
| 19 - 22 | 2 |
| 23 - 27 | 3 |
| 28 - 32 | 4 |
| 33 - 37 | 5 |
| 38 - 42 | 6 |
| 43 - 47 | 7 |
| 48 - 52 | 8 |
| 53 - 57 | 9 |
| 58 - 62 | SPARE |
| 63 - 67 | SPARE |
| 68 - 72 | SPARE |
| 73 - 77 | SPARE |
| 78 - 82 | SPARE |
| 83 - 87 | SPARE |
| > 88 | OLD MILES |

FIG. 8B

LASER FREQUENCY MODULATION TACTICAL TRAINING SYSTEM

This application is a division of application Ser. No. 09/744,453, filed Jan. 23, 2001 which is a 371 of PCT/US99/12817 filed Aug. 3, 1999 which claims benefit of Provisional No. 60/095,616 filed Aug. 7, 1998.

BACKGROUND OF THE INVENTION

The present invention relates to multiple integrated laser engagement system (MILES), and in particular to a system for and a method of encoding a MILES code word to convey a significantly increased amount of information.

MILES has revolutionized the manner in which armies train for combat, and has become the standard against which all other tactical engagement simulation (TES) systems are measured. It is highly valued for its ability to accurately assess battle outcomes and to teach soldiers the skills required to survive in combat and destroy an enemy. With MILES, commanders at all levels can conduct opposing force free-play tactical engagement simulation training exercises that duplicate the lethality and stress of actual combat.

The MILES system uses laser bullets to simulate the lethality and realism of a modern tactical battlefield. Laser transmitters, capable of shooting pulses of encoded infrared energy, simulate the effects of live ammunition. The transmitters are easily attached to and removed from hand-carried and vehicle mounted direct fire weapons. Detectors located on opposing force troops and vehicles receive the coded laser pulses. MILES decoders then determine whether a weapon that could cause damage to the target hit the target and whether the laser bullet was accurate enough to cause a casualty. The target vehicles or troops are made instantly aware of the accuracy of the shot by means of audio alarms and visual displays, which can indicate either a hit or a near miss.

Detectors located on a target receive the encoded infrared energy transmitted upon firing a weapon. In the case of ground troops, the detectors are normally installed on webbing material that resembles a standard-issue load-carrying lift harness. Additional detectors may be attached to a web band that fits on standard-issue helmets. For vehicles, the detectors are mounted on belts that attach to the front, rear, and sides of the vehicles. The detectors provide 360° coverage in azimuth and sufficient elevation coverage to receive the infrared energy during an air attack. The arriving pulses that are sensed by detectors are amplified and compared to a threshold level. If the pulses exceed the threshold, that information is registered in detection logic. Once a proper arrangement of information exists, corresponding to a valid code for a particular weapon, the decoder decides whether the code is a near miss or a hit. If a hit is registered, a hierarchy decision is then made to determine if the specific weapon can indeed cause a kill against the particular target and, if so, what the probability of a kill might be.

Because MILES is a pulse-code-modulation optical communication system in which the transmission medium is the atmosphere, the encoded message is inherently transmitted through and affected by varying atmospheric conditions. When received, the encoded message is decoded to initiate required actions. Ideally, the message as decoded accurately represents weapon firing characteristics, round dispersion patterns, and the probability of hit as a function of range for specific weapon systems.

The standard defining the MILES code structure contains weapon codes and player identification (PID) codes embedded in it. The present MILES code word structure does not allow the transmission of any additional information, due to pulse timing constraints. In consequence, only a limited amount of information can be encoded and transmitted, which reduces the fidelity of casualty assessments and provides an inadequate after-action-review.

The MILES system is based on the receiving system receiving an encoded laser word. Each unique weapon system is fitted with a laser transmitter to match its weapon characteristics. The energy of the laser transmitter is preset to match the weapon system characteristics for a given laser detection system sensitivity and atmospheric conditions. Thus, the energy of the laser transmitter and the sensitivity of the detection system have to be properly set and maintained to accurately simulate the effect a weapon would have on a target. The negative effects of atmospheric attenuation (e.g., continuum atmospheric attenuation, water vapor attenuation, and scintillation) are accepted as inherent limitations to the fidelity of the MILES system.

It would be desirable to improve the MILES system to enable transmission of additional information (e.g. GPS position/location, range, elevation, lead angle, impact point of a projectile, etc.). This would greatly enhance the fidelity of hits and casualty assessments. This additional information would also provide for a vastly enhanced after action review, and enable a soldier to better train for future missions. Further, the transmission of GPS position/location would eliminate the need to carefully set and maintain the energy and sensitivity of associated laser transmitter and detection systems Known laser based tactical engagement simulation training systems are disclosed by U.S. Pat. Nos. 4,629,427, 4,662,845 and 4,823,401, the teachings of which are specifically incorporated herein by reference.

OBJECTS OF THE INVENTION

An object of the present invention is to provide an improved laser based tactical engagement simulation training system.

Another object is to provide an improved MILES system that enables the transmission of an increased amount of information in a MILES code word.

A further object is to provide such a MILES system in which individual bits of information in a standard encoded MILES word are modulated to contain additional information.

Still another object is to provide such a MILES system in which the bits of information in the standard MILES code word are FM modulated.

Yet another object is to provide such a system that is downward compatible with a standard MILES system.

SUMMARY OF THE INVENTION

In accordance with the present invention, there is provided an improved MILES code word structure in which FM modulated pulses of selected frequencies occur in the same positions in the code word as would individual bits of logic level "1" in a standard MILES code word. In the improved MILES code word, each selected frequency is assigned a value unique to it, and an FM modulated bit in a predetermined position in the code word has a frequency indicative of information conveyed by the remaining FM modulated bits of the same code word. Each FM modulated bit comprises at least two pulses at a selected frequency occurring during the same time frame as would the logic "1" bit of the standard MILES code word, and the frequency of each the FM modulated bit is determined according to the formula f=1/t, where t is the time interval between leading edges of two successive pulses of individual ones of the FM modulated bits.

There also is provided an improved MILES system. The system comprises means for generating a MILES code word having a standard MILES code word structure in which a predetermined number of bits are logic level "1" and are in bit positions selected to convey standard required information, and in which the remaining bits are logic level "0". Means are included for FM modulating to selected frequencies individual ones of the logic level "1" bits of the standard MILES code word, and each selected frequency has an assigned value, so that the FM modulated MILES code word contains both the standard required information and information in addition to the standard required information.

The improved MILES system advantageously includes means for controlling operation of a laser to generate and transmit a pulsed laser signal representative of the FM modulated MILES code word. There are means for receiving and decoding the pulsed laser signal to obtain therefrom at least the standard required information contained in the FM modulated MILES code word, and preferably both the standard required information and the additional information. A predetermined one of the FM modulated bits of the code word has a frequency indicative of the nature of the information conveyed by the remaining FM modulated bits of the same code word, and advantageously the predetermined one of the FM modulated bits is the first FM modulated bit of the code word. Each FM modulated bit comprises at least two pulses at a selected frequency and occurring during the same time frame as the original logic "1" bit, and the frequency of each is determined according to the formula f=1/t, where t is the time interval between leading edges of two successive pulses of the FM modulated bit.

The means for controlling operation of the laser includes a laser driver that provides constant power or energy to the laser for each pulse output by the laser. The means for receiving and decoding the pulsed laser signal includes a detector for receiving and generating an amplified representation of the received pulsed laser signal and means for generating a signal representative of occurrence of a logic "1" bit in response to occurrence of either an FM modulated logic "1" bit or a logic "1" bit of a standard MILES code word.

The invention also provides a method of generating an improved code word for a laser based tactical engagement simulation training system of a type in which a standard code word for the system consists of a plurality of bits of logic level "1" in selected positions in the code word, with the remainder of the bits being of logic level "0". The method comprises the steps of providing a standard code word, and FM modulating to selected frequencies individual logic level "1" bits of the standard code word Advantageously, each selected frequency is assigned a value unique to it, and a logic level "1" bit in a predetermined position in the standard code word is FM modulated to have a frequency indicative of information conveyed by the remaining FM modulated bits of the same standard code word. FM modulating causes at least two pulses at a selected frequency to occur during the same time frame as a logic "1" bit, and the frequency to which logic "1" bits are modulated is controlled according to the formula f=1/t, where t is the time interval between leading edges of two successive pulses of individual ones of the FM modulated bits.

In the described embodiment the method generates an improved MILES code word, and comprises the step of modifying individual ones of the logic level "1" bits of a standard MILES code word to contain information in addition to the information required to be contained in the standard MILES code word. The modifying step may comprise embedding into individual ones of the logic level "1" bits of the standard MILES code word information in addition to the information required to be contained in the standard MILES code word, and in the described embodiment comprises FM modulating individual ones of the logic level "1" bits. The FM modulating step includes modulating the logic level "1" bits to have selected frequencies, and to each selected frequency is assigned a value unique to it. Also, logic level "1" bit in a predetermined position in the standard code word is FM modulated to have a frequency indicative of information conveyed by the remaining FM modulated bits of the same code word, and FM modulating causes at least two pulses at a selected frequency to occur during the same time frame as a logic "1" bit. The frequency to which logic "1" bits are modulated is controlled according to the formula f=1/t, where t is the time interval between leading edges of two successive pulses of individual ones of the FM modulated bits.

The invention further contemplates a method of operating a MILES system, comprising the steps of generating a MILES code word having a standard MILES code word structure in which a predetermined number of bits are logic level "1" and are in bit positions selected to convey standard required information, and in which the remaining bits are logic level "0"; modifying individual logic level "1" bits of the standard MILES code word to contain information in addition to the required information; and controlling operation of a laser in response to the modified code word to generate and transmit a pulsed laser signal representative of the modified code word. The modifying step may comprises embedding the additional information into individual ones of the logic level "1" bits of the standard MILES code word, although as described it comprises FM modulating individual ones of the logic level "1" bits.

Included in the method of operating the system is receiving and decoding the pulsed laser signal to obtain therefrom at least the standard required information contained in the modified code word, and advantageously both the standard required information and the additional information. Further, a predetermined one of the logic "1" bits is modified to contain information identifying the nature of the information conveyed by the remaining modified bits of the same code word, and the predetermined bit advantageously is the first logic "1" bit of the MILES code word.

Each FM modulated bit comprises at least two pulses at a selected frequency and occurring during the same time frame as the original logic "1" bit, and the FM modulating step is performed so that the frequency of each FM modulated bit is determined according to the formula f=1/t, where t is the time interval between leading edges of two successive pulses of the FM modulated bit. Controlling operation of the laser operates a laser driver to provide constant power or energy to the laser for each modified logic "1" bit to be output by the laser.

The foregoing and other objects, advantages and features of the invention will become apparent upon a consideration of the following detailed description, when taken in conjunction with the accompanying drawings.

BRIEF DESCRIPTION OF THE DRAWINGS

FIG. 3 shows the structure of an FM modulated code word in which GPS information is embedded;

FIG. 4 lists the frequencies contemplated to be embedded in a FM modulated code word and their assigned values;

FIGS. 5A-5F are signal waveforms illustrating the downward compatibility of the FM modulated MILES code word structure of the invention;

FIG. 7B is a table showing communication sequences between a SAT and a tactical training helmet (TTH);

FIG. 7C is a table showing the various frequencies of FM modulated pulses of FM modulated MILES code words;

FIG. 8B is a table showing the values assigned to a count generated by a frequency counter logic circuit of the encoder.

DETAILED DESCRIPTION

Prior Art

Existing MILES is a pulse code modulation optical communication system through the atmosphere. Representative pairing between weapon and target systems is achieved by accurately setting weapon laser power and divergence and target detection sensitivity, with assumptions being made for typical atmospheric visibility and scintillation conditions. Range dependencies of weapons are achieved by an indirect method of dependence on the number of kill words received and information communicated is limited to weapon code and player identification (PID). Due to the limited number of codes available, each weapon code represents a group of similar weapons (e.g., code 27 represents all small arms: M16, M240, M60 and M249).

Figure 1:
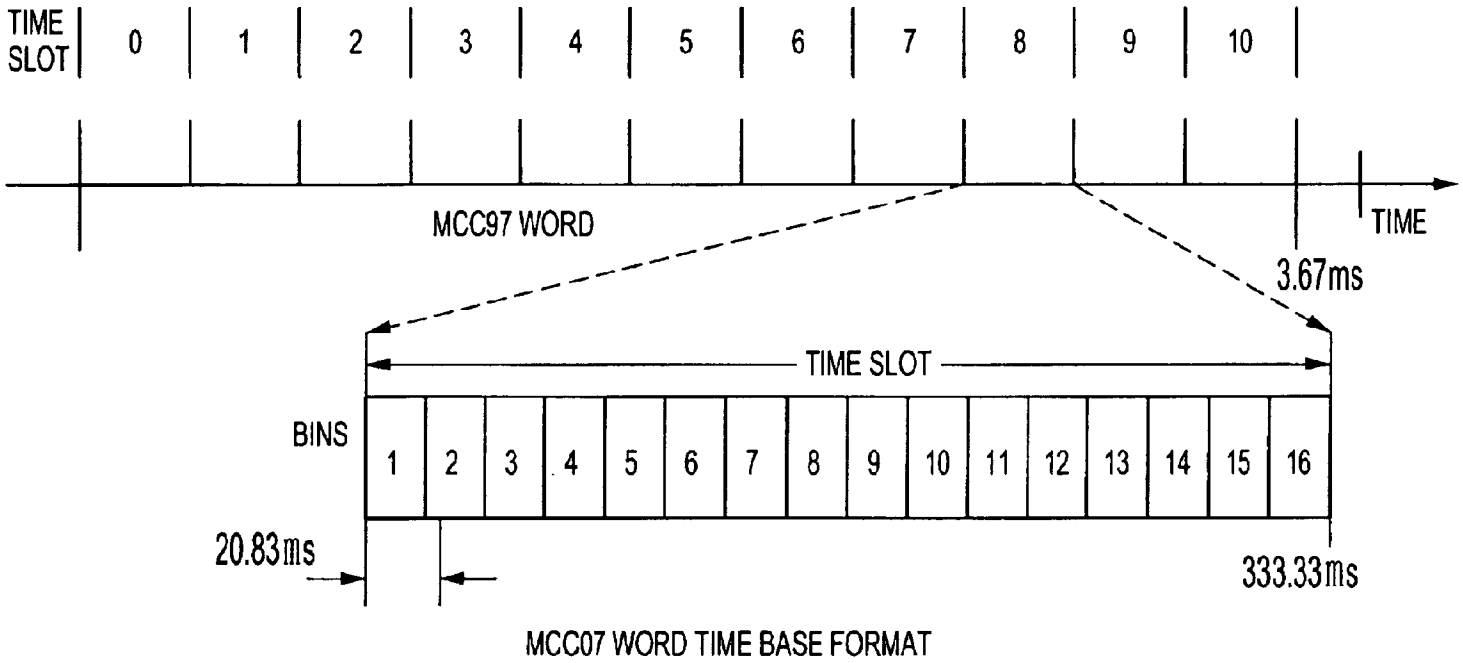
FIG. 1 (PRIOR ART)
FIG. 1 shows the structure of a standard MILES code word.

FIG. 1 shows the structure of a standard basic MILES code word. The requirements for an encoded MILES code word are defined in Standard for MILES communication Code Structure, MCC97 (PMT 90-S002B). That Standard defines the content and code structure for MILES codes and all variants of MILES, and applies to all MILES equipment and to all equipment having communication interface with any MILES equipment. The Standard requires that the basic MILES code structure consist of code words each having a unique and identified bit pattern. The basic MILES code word must be composed of eleven bits with a weight of 6 bits always equaling logic "1" and the remaining five bits always equaling logic "0". The basic MILES code word identifier, that identifies to a receiver that the code word is a MILES code word, is the first three bit positions, and in all cases the identifier bit pattern must be "1 1 0". The basic MILES code bits are synchronized in time to the leading edge of the first bit of the basic MILES code word identifier, and the leading edges of two successive basic MILES code bit positions must occur at a 3 kHz+/−0.015% rate (333 microsecond intervals). The time interval required to complete one basic MILES code word is 3.667 milliseconds.

The Standard calls for a MILES decode sampling scheme in which the time interval between successive basic MILES code word bits is divided into sixteen sampling BINS numbered by convention 1 to 16, with BIN 1 of each interval always being occupied by a basic MILES code bit (logic "0" or logic "1"). The MILES decode sampling rate is 48 kHz, sixteen times the 3 kHz bit position time slot generation rate. The result of the sampling is to divide the time between two successive basic MILES code word bits into sixteen sampling BINS, each being approximately 20.8 microseconds long. Every MILES system code word therefore consists of 176 decode sample BINS evenly distributed among the 11 basic MILES code word bits. The standard MILES PID consists of the basic MILES code words specified in the Standard, interlaced with any one of the PID code bit patterns also specified in the Standard. The standard MILES PID code word is composed of eleven bits with a weight of four bits always equaling logic "1" and the remaining equaling logic "0". Each PID number is uniquely assigned to a PID code bit pattern, and the PID code bits occur in sampling BIN number 6, 8 or 10.

The encoded MILES code word is transmitted via a laser of a small arms transmitter (SAT). The ability to successfully complete the transmission of the encoded message is significantly affected by the code word structure, message format, decoding method and threshold setting of the detector. Conversely, the ability to avoid false message reception is affected by the same factors The functions of the MILES code are therefore to: (1) discriminate between weapon types with high reliability; (2) extend weapon simulator range in the presence of adverse atmospheric conditions; (3) reject random false signals; and (5) shape the kill zone profile vs. range to more accurately simulate weapon effectiveness. Existing MILES encoding schemes are hard pressed to meet these requirements.

The Invention

The invention provides an improved laser based tactical engagement simulation training system. In particular, there is provided an improved communication code structure for such a system. There also is provided means for encoding transmitting, receiving, decoding and processing information embodying the improved code structure, in a manner that significantly enhances tactical engagement simulation for direct fire force-on-force training, and that yields more accurate simulation to improve tactical training results.

According to the invention, information over and above that required to be embodied in a standard MILES code word is embedded in the standard code structure for the word. The additional information is embedded in the standard MILES code word in a manner that enhances the system, while at the same time maintaining downward compatibility with existing MILES systems.

Standard MILES code pulses comprise a basic MILES code word composed of 11 bits with a weight of 6 bits always equaling logic "1". By definition, the first 3 bits of the code word must be logic "1 1 0", which identify the code word as a MILES code word. The remaining 8 bits identify weapon type, and since they have a weight of 4 bits equaling logic "1", they are limited to identifying 36 weapon types. The leading edges of the bits occur at a 3 kHz rate, i.e., at 333 microsecond intervals. The time intervals between successive bits are each divided into 16 decode sampling BINS, with BIN 1 in each interval always being occupied by a basic MILES code bit (logic "1" or "0"). The sampling BINS occur at a 48 kHz rate, i.e., at 20.8 microsecond intervals, which is 16 times the 3 kHz bit generation rate. The MILES code word therefore consists of 176 decode sample BINS evenly distributed among the 11 basic MILES code word bits. BINS 6, 8 and 10 are or containing player identification (PID) code, which is composed of 11 bits having a weight of 4 bits always equaling logic "1" and the remaining bits equaling logic "0". The standard MILES code word therefore has 176 sampling BINS numbered 1–16 between each code word bit, with BINS 1 always being occupied by a standard code word bit and BINS 6, 8 or 10 being occupied by PID bits. The MILES code word thus has a total weight of 10 bits always equaling logic level "1".

To embed additional information into the standard MILES code word structure, the invention contemplates an FM modulated MILES code word, in which the standard logic level "1" word bits are FM modulated. Specifically, the normal MILES code bits, each of which consists of a single pulse, are replaced with two or more pulses at a set frequency, during the same code pulse time frame, i.e., within the same BIN in which the normal pulse occurs. The particular frequency resulting from the FM modulation is determined by the time interval between the leading edges of the two pulses that replace the standard single MILES code word pulse, according to the formula f=1/t.

Figure 2:
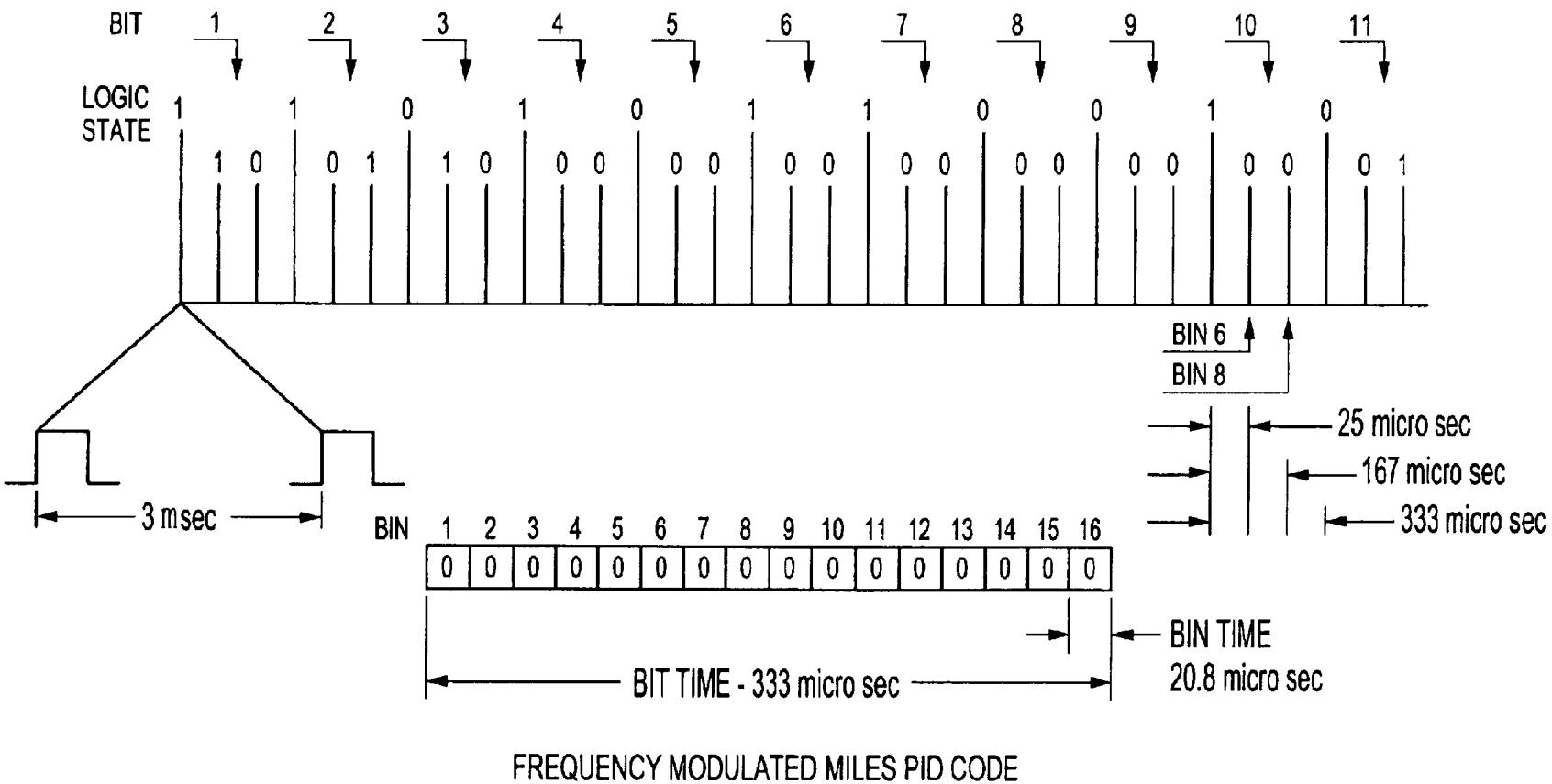
FIG. 2 shows an FM modulated MILES code word structured according to the invention.

FIG. 2 shows the structure of an FM modulated MILES code word. There are a total of 10 pulse positions, i.e., bits of logic level "1", in the code word. By replacing each logic level "I" bit with pulses at a selected frequency, a significant amount of additional information can be embedded in and transmitted over the laser via the code word. Using just 10 unique frequencies, a total of $10^{10}$ numbers of data can be transmitted. Examples of data to be transmitted include GPS position, weapon range, elevation/lead angle, impact point, etc. It presently is contemplated that 10 unique frequencies be implemented by the FM modulation encoding technique, and that the system be capable of 5 additional frequencies for future growth. FIG. 2 shows that in the first pulse position, the single standard pulse has been FM modulated by being replaced by two pulses, the time interval between the leading edges of which is 3 $\mu$sec, representing a frequency of 333.33 kHz.

Of the 10 pulse positions available in each MILES code word, the first pulse position is used to embed an identifier. The particular frequency embedded in the first position identifies the information embedded in the following 9 pulse positions. FIG. 3 shows an example of GPS position embedded into a MILES code word. FIG. 4 lists the embedded frequencies presently contemplated and their corresponding assigned values. Thus, to transmit a value of 357 in bit or pulse positions 2, 3 and 4, the corresponding frequencies will be 400 kHz, 285.71 kHz and 222.22 kHz.

A standard system for locating a position on earth is the Earth Centered, Earth Fixed Cartesian Coordinates (ECEF X, Y, Z). It defines three-dimensional positions with respect to the center of mass of the reference ellipsoid. If, for example, "frequency 1" in the first pulse position of a MILES code word is used to indicate that GPS information follows, then that would indicate that the following 9 pulse positions of the code word contain GPS coordinate position data. For conveying GPS position data, each direction (X, Y and Z) may be allocated 3 of the 9 pulse positions. Using 10 different frequencies, each direction can be represented by a number from 0 to 999. The position transmitted is the difference between the transmitting system's present position and a fixed pre-designated reference point on a playing field. Position information may be transmitted in 11 meters resolution. This eliminates the need to accommodate millions of meter ranges for each direction and enables transmission of the entire GPS position within one code word. It provides for a playing field of 5,500 meters in each direction (X, Y and Z), from the reference point. Either increasing the number of frequencies used and/or reducing the position resolution can accommodate larger playing fields. Even though the position is transmitted in 11 meter resolution, the transmitting system checks the remainder during division by 11, and increments the number if it is greater than 0.5. This results in a loss of only 5 meters accuracy in each direction. A receiving system that receives the code word decodes the code word, extracts each direction information and multiplies the result by 11 (e.g. x1, y1, z1). The receiving system, which would incorporate its own GPS sensor, then computes the difference between its present position and the pre-designated reference point (e.g. x2, y2, z2). The receiving system then computes the range to the transmitting system, using the formula to compute distance between three-dimensional Cartesian coordinates $\sqrt{[(x1-x2)^2+(y1-y2)^2+(z1-z2)^2]}$. Based on the distance to the target and the weapon code, the receiving system performs casualty assessments. Incorporating range as information specifically transmitted significantly enhances the fidelity of casualty assessments and provides for a very useful after action review.

The improved FM modulated MILES communication code word structure is downward compatible. That is, a transmitted MILES code word that is structured to be embedded with additional information, can be detected and decoded by an existing MILES decoder, although the information obtained from decoding will not include the information added, but only that which was in the basic MILES code word. In this connection, the laser signal from the FM small arms transmitter (SAT) consists of a short series or burst of two or more pulses, at selected frequencies, placed in each of the existing MILES single bit locations where bits of logic level "1" occur. A typical existing MILES laser pulse width is between 100 and 500 nanoseconds wide. The series of FM pulses inserted in place of the existing laser pulses are reduced in width and/or adjusted in peak power so as to maintain the same average laser output energy as the single MILES laser pulse. This is done to maintain downward compatibility with existing MILES detectors, which integrate each incoming laser pulse and output a valid data bit if the energy of an incoming pulse is over a preset threshold. FIG. 5A shows an existing MILES laser pulse that may be sensed by an existing MILES integrating detector, causing the detector to generate an output signal as shown in FIG. 1B. The level of the detector output signal is compared to a preset threshold, and for as long as it is greater than the threshold results in generation of a comparator output pulse as shown in FIG. 5C. The comparator output pulse, along with other such pulses that together make up a MILES word, are used for decoding the information contained in the word.

FIG. 5D shows a pulse of an FM modulated MILES code word in which additional information is embedded. When such an FM encoded pulse is detected by an existing MILES integrating detector, the pulses are integrated and result in a detector output signal as shown in FIG. 5E. The level of the detector output signal is compared to a preset threshold, and for as long as it is greater than the threshold results in generation of a single comparator output pulse as shown in FIG. 5F. The comparator output pulse, along with other such pulses that together make up a MILES code word, are used for decoding the information contained in the word and provide the same data fidelity as if the FM modulated signal were transmitted by an existing MILES transmitter. This process provides for MILES code words, which are FM modulated according to the invention, to be downward compatible with existing or old MILES equipment In other words, the FM modulated laser signal transmitted by an FM SAT embodying the teachings of the invention, can be received and decoded by an existing MILES detector, although only the information embodied in the basic MILES code word will be extracted from the signal.

Figures 6A, 6B, 6C, 6D, 6E, 6F:
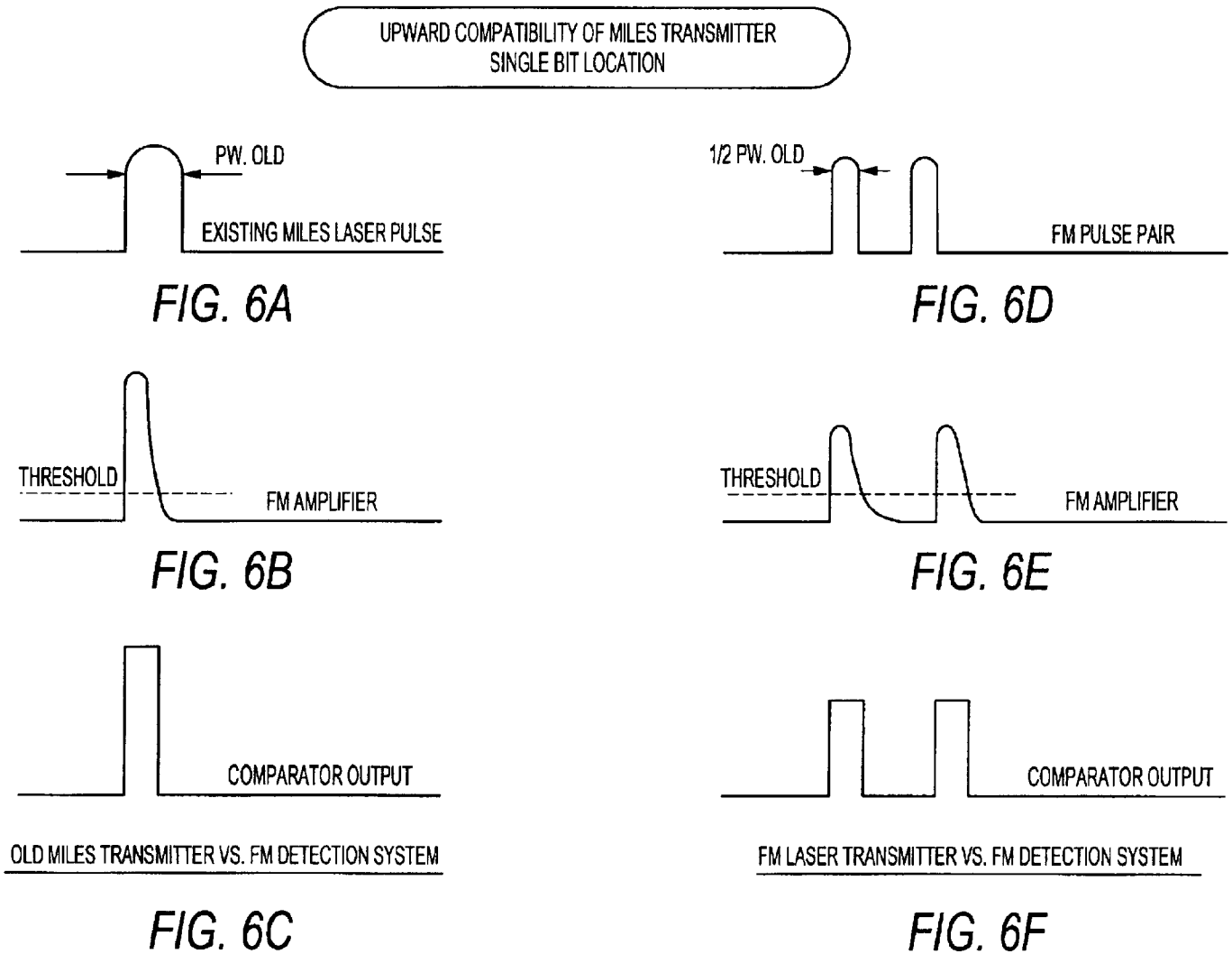
FIGS. 6A-6F are signal waveforms illustrating the upward compatibility of the FM modulated MILES code word structure of the invention.

The improved MILES code word structure is also upward compatible, such that an FM detection system that decodes an FM modulated MILES code word structured according to the invention also can decode an existing MILES code word, while maintaining the data fidelity provided by the respective SAT transmitters. FIGS. 6A-6C illustrate the upward compatibility of the system. An existing transmitted MILES code word pulse is shown in FIG. 6A, which is received by a detector of the FM detection system or receiver. In response to receiving the existing MILES code word pulse, the detector integrates the pulse and generates an output signal as shown in FIG. 6B. The detector output signal is applied to a comparator and, if it is above a preset threshold level, the comparator generates at its output a single short output pulse, as shown in FIG. 6C. The output signal from the comparator is applied to an FM decoder, which recognizes that there is only a single pulse and decodes the pulse as an existing or old MILES code, with its corresponding data fidelity.

FIGS. 6D-6F illustrate some of the signals involved in receiving and decoding a MILES code word having an FM modulated code structure according to the invention. A detector of the FM receiver receives an FM modulated laser pulse signal, shown in FIG. 6D. In response to detecting the FM modulated MILES laser pulse signal, the detector integrates the pulses of the signal and generates an output signal as shown in FIG. 6E. The detector output signal is applied to a comparator, and if it is above a preset threshold level causes two short output pulses to be generated by the comparator, as shown in FIG. 6F. The output signal from the comparator is applied to an FM decoder, which recognizes that there are two individual pulses and decodes the pulses as being part of an FM modulated MILES code word structured according to the invention. The FM modulated MILES code word signal, when decoded by the FM decoder, provides all the enhanced data, such as GPS position, to the system.

Figure 7A:
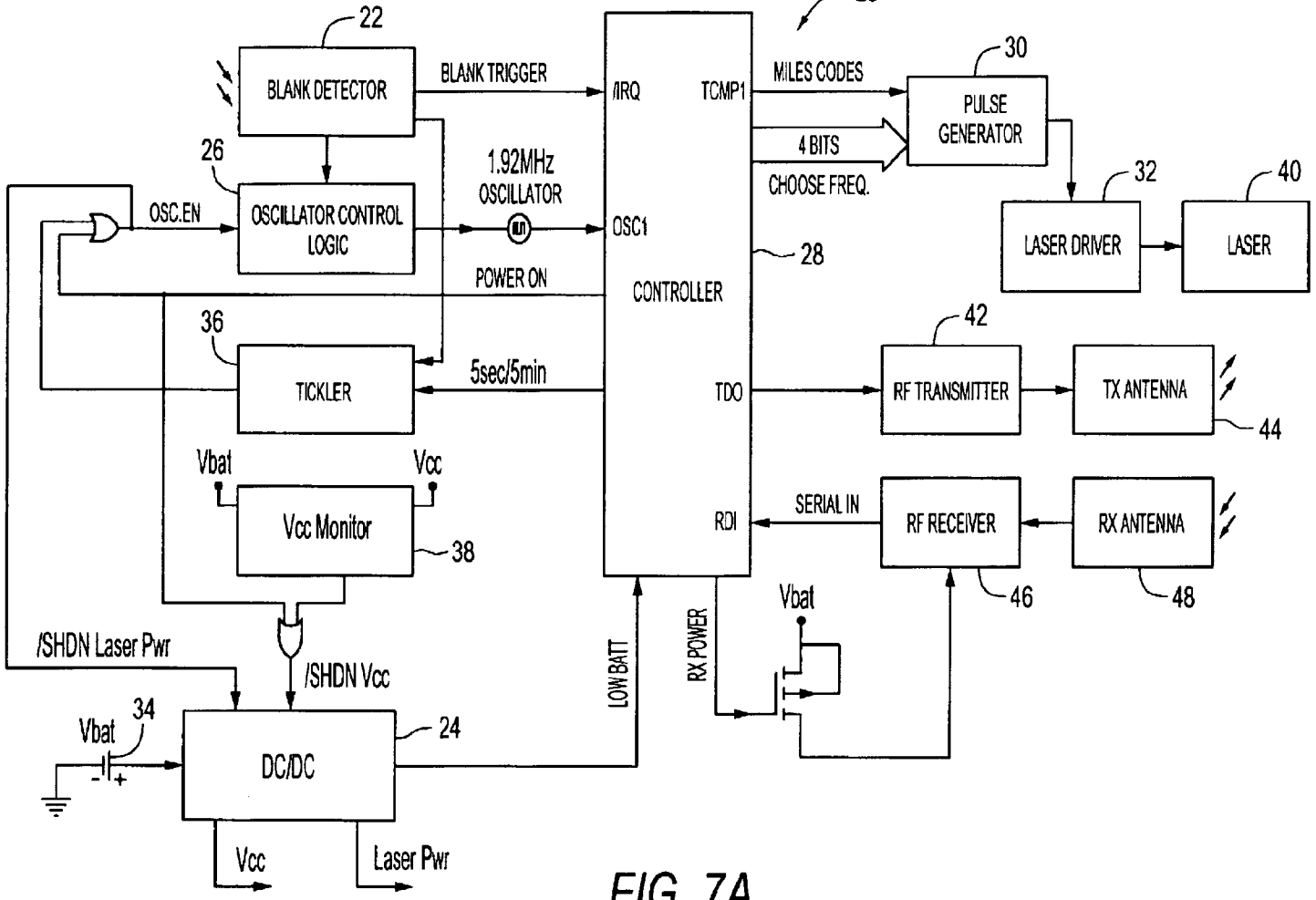
FIG. 7A is a block diagram of an encoder for generating FM modulated MILES laser code pulses.

FIG. 7A shows an encoder of the SAT, indicated generally at 20. The encoder is associated with a weapon and coupled to a tactical training helmet (TTH), which TTH is advantageously of the type described on co-pending application entitled "Integrated Laser Frequency Modulation Tactical Training Helmet", filed contemporaneously herewith as Serial No. and the teachings of which are specifically incorporated herein by reference. The encoder includes a blank detector circuit 22 that detects the shock and/or electric pulse that occurs when a weapon is fired. When the weapon is fired, the blank detector circuit generates a pulse that turns on a dc-dc converter 24, enables an oscillator control logic circuit 26, and informs a controller 28 that the weapon has been fired, so that the controller can generate appropriate MILES codes and output them to a pulse generator 30 and a laser driver 32.

A rechargeable or disposable battery 34 powers the SAT. To conserve battery power, the oscillator control logic 26 is normally disabled and can be enabled in several ways. A pulse generated by the blank detector 22 or by a tickler circuit 36 turns on the oscillator for an instant. However, as soon as the oscillator control logic is turned on, the controller 28 is enabled and keeps the oscillator and dc-dc converter 24 enabled for as long as necessary to process the required operations. Pushing a button (not shown) on the SAT, to enable or disable the weapon, also turns on the oscillator.

To keep communications open between the SAT and a TTH worn by a soldier using the weapon with which the SAT is associated, the tickler circuit 36 turns on the oscillator 26 at controllable intervals. When the weapon is enabled and in the possession of its "owner", the tickler enables the oscillator every few seconds to communicate different events, as shown in FIG. 7B, to the soldier via the TTH. If the SAT receives a "kill" message, or if the weapon is not in the possession of its owner, the tickler will switch the oscillator turn-on intervals from a few seconds to a few minutes to conserve battery power.

Energy stored in a capacitor (not shown) powers the system when the dc-dc converter 24 is disabled. As the energy in the capacitor decreases, circuit voltage VCC, normally output from the dc-dc converter 24, will drop. When the voltage VCC drops below a selected threshold, a VCC monitor 38 turns on the dc-dc converter to recharge the capacitor, and then turns off the dc-dc converter when the voltage VCC increases to above the threshold.

The dc-dc converter 24 increases the output voltage from the battery 34 to a higher voltage required for the voltage VCC and to power a laser diode 40. Since the power stored in a charged-capacitor is used to power the system when the system is inactive, the dc-dc converter is normally in shutdown mode. However, when the tickler 36 is activated, the weapon is fired, or a button (not shown) on the SAT is pushed to enable or disable the weapon, the dc-dc converter will be turned on, since the system is now active and requires more power than the charged-up capacitor can provide. The dc-dc converter also monitors the voltage of the battery 34 and generates a "low battery" signal that is sent it to the controller 28 when low battery voltage is detected.

The pulse generator 30 embeds the additional information into the standard MILES code word by converting each standard MILES code pulse received from the controller 28 into a set of two pulses. The space or time interval between the leading edges of the two pulses represents the frequency of the FM modulated pulse according to the equation $f=1/t$, and is assigned a value that results in the MILES code word being embedded with additional information. The particular value of the space or time interval is controlled by a 4-bit input from the controller, as shown in FIG. 7C, which four bits are presently used to encode 10 different frequencies or time intervals, but if desired could be used to encode up to 16 different frequencies or time intervals. The output from the pulse generator is applied as an input to the laser driver 32, which is a high speed, high current pulse driver that provides constant power/energy for each laser pulse output by the laser diode 40. The laser diode generates a pulsed optical laser output in response to inputs from the laser driver and at the pulse spacing defined by the controller. The laser is aimed at a MILES equipped target, such as a TTH, and when the blank deter 22 senses the fixing of a blank and initiates the process, the optical code sequence is sent out. The optical code sequence is then decoded by the target and assessed accordingly.

Radio frequency (RF) communication between the SAT and TTH carried and worn by the "owner", e.g. by a soldier, is always initiated by the SAT. Whenever the oscillator 26 is enabled, the controller 28 generates a "hello" message and sends it serially to an RF transmitter 42. The message flows serially from the RF transmitter to a transmit (TX) antenna 44, from which where it is radiated into the atmosphere to initiate communications with the TTH. The data is transmitted using a specific frequency, so that the TTH can wait for data to receive at this same frequency.

A radio frequency (RF) receiver 46 obtains signals from a receive (RX) antenna 48, which in turn collects RF signals from the atmosphere. The RF receiver transmits the signals serially to the controller 28 so that they can be processed. The RF receiver only detects and sends to the controller those signals that are of the same frequency as that transmitted by the TTH. Since the SAT always initiates communications, power to the RF receiver 46 normally is turned off to conserve battery. Power to the RF receiver is enabled after the SAT initiates communications with the TTH and is disabled after it receives a "communications over" message. Power to the RF receiver also is disabled if there is no response from the TTH for a specified time.

The TX and RX antennas 44 and 48 are used to transmit and receive RF data. Since RF communications between the SAT and TTH take place in a very short range, the antennas do not have to be high quality. For this reason, these short-range antennas may economically and conveniently be printed directly on the circuit board for the encoder.

The controller 28 provides all the processing and signal generation functions for the system. The controller generates both the MILES code words and the frequency selection bits that control the pulse generator 30, to cause the pulse generator to FM modulate the standard MILES code word in a manner to embed therein additional information to be transmitted by the laser, such for example as GPS position. The controller processes RF messages that are to be transmitted, as well as RF messages that are received. The controller also handles power management, blank fire detection interrupts, and built-in-testing.

Figure 8A:
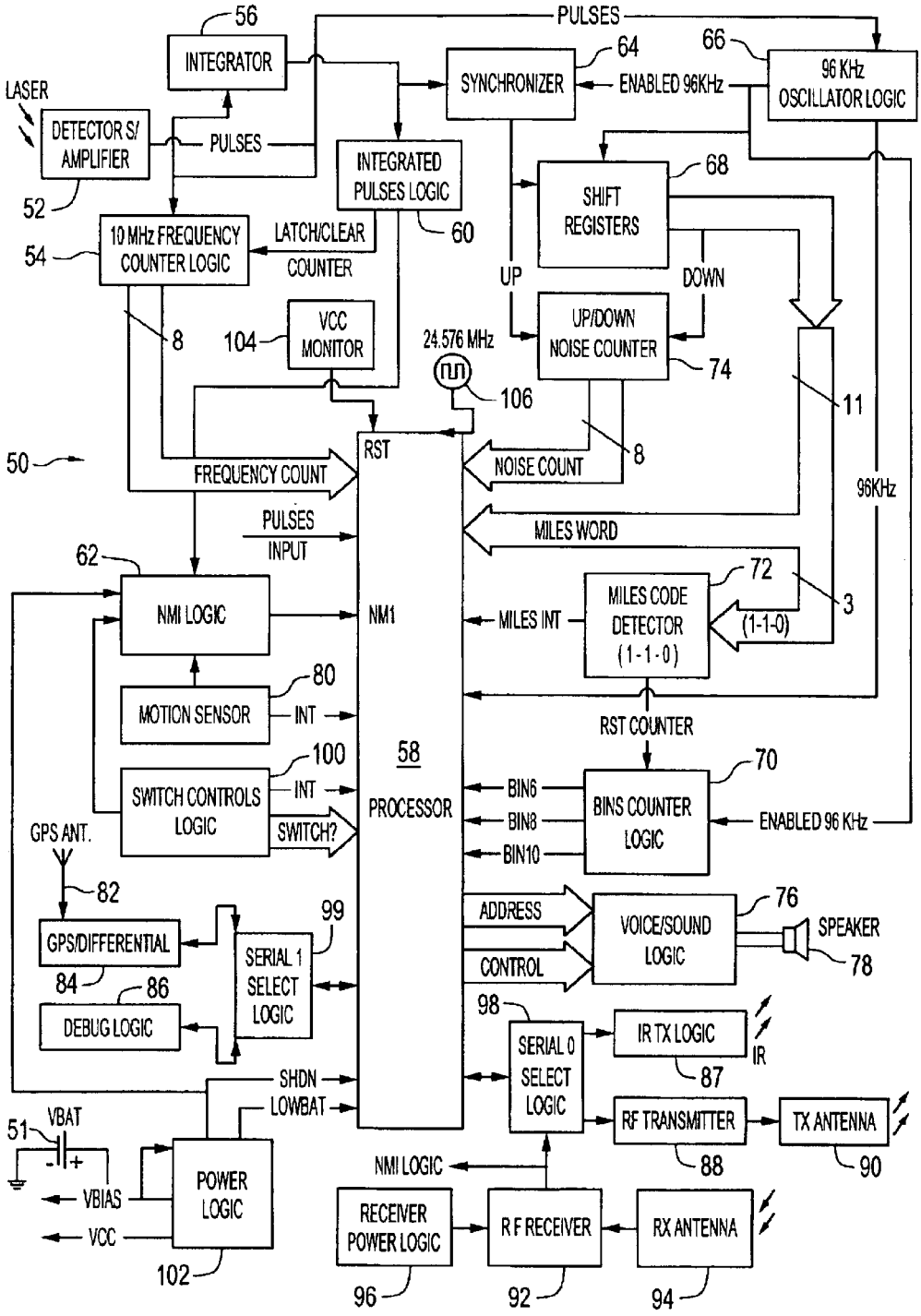
FIG. 8A is a block diagram of a decoder for receiving and processing FM modulated MILES laser code pulses.

FIG. 8A shows a decoder, indicated generally at 50. The decoder is associated with a TTH and powered by a rechargeable battery 51, and includes a detectors/amplifier circuit 52 that includes laser detectors in the TTH that have a low capacitance and are very fast. The detectors are used to detect existing MILES code laser pulses or the new FM MILES code laser pulses, and a fast pulse amplifier of the detectors/amplifier uses the signal from the detectors to generate pulses at a level required by the decoder system. The high speed of the detectors/amplifier is required to respond to the new FM MILES code structure, which has an increased pulse rate in that it replaces each standard MILES code word bit with two pulses. However, the detectors/amplifier can also process conventional or existing MILES code laser pulses. The detectors are further used as the receiving end of weapons that use a short-range optical link for communications.

The detectors/amplifier 52 generates output pulses, in response to laser pulses, that enable a 10 MHz frequency counter logic circuit 54 and are applied to an integrator 56. In the case of the FM MILES code structure of the invention being received, a pair of pulses replaces each standard MILES code pulse, the first pulse enables the 10 MHz oscillator and the second pulse disables the oscillator. The frequency counter logic circuit is used to count the number of pulses generated by the 10 MHz oscillator while it is enabled. When an existing MILES code structure is received, a second pulse is not received, in which case the oscillator is automatically disabled after a specific time by a latch/clear counter pulse, and a count of about 100 is generated. This maximum count of about 100 is used to differentiate between the existing MILES and the FM MILES code structures. The latch/clear counter pulse used to automatically disable the oscillator is also used to latch a count for a processor 58 and to clear the frequency counter logic circuit. The frequency counter logic circuit is now ready for the next MILES code pulse, or set of two pulses for FM MILES. The magnitude of the count generated by the frequency counter logic circuit for FM MILES code pulses depends on the width or time interval between the leading edges of the two pulses. FIG. 8B shows the value assigned to each count.

The integrator 56 integrates incoming pulses from the detectors/amplifier. Whether it receives a single pulse, as in existing MILES, or a set of two or more pulses, as in the new FM MILES code structure of the invention, the integrator will output a single pulse of the same pulse width.

Integrated output pulses from the integrator 56 are applied to an integrated pulses logic circuit 60. Trailing edges of the integrated pulses cause the integrated pulses logic circuit to generate a latch/clear counter output that disables the 10 MHz frequency counter logic circuit 54, thereby stopping the frequency counter logic circuit when only one pulse is received, as in existing MILES code words. This same trailing edge generates a second pulse, which latches the count and is applied as an input to a non-maskable interrupt (NMI) logic circuit 62. The NMI logic circuit generates a NMI signal to bring the processor 58 out of a power-down mode. After the count has been latched and the processor activated to read and process the count, the trailing edge of the second pulse is used to clear the frequency counter logic circuit to get it ready for the next MILES code pulse.

The integrated MILES code pulses are also input to a synchronizer 64 that receives an output from a 96 kHz oscillator 66 and aligns the integrated pulses with the oscillator output. This is essential since the MILES code pulses need to be aligned with the oscillator output so that the processor 58 can read and decode them as they are being clocked through a shift register 68.

The output from the 96 kHz oscillator 66 is also applied directly to the T1 input of the processor 58. The shift registers 68 and a BINS counter logic circuit 70 also receive the output from the 96 kHz oscillator. However, the 96 kHz signal going to the synchronizer, shift register and BINS counter logic circuit is normally disabled to reduce power consumption, and is enabled by pulses output from the detectors/amplifier circuit 52. After processing of MILES code pulses is completed and there are no further incoming pulses, to conserve battery power, the processor disables the 96 kHz oscillator.

When the 96 kHz oscillator 66 is enabled, the shift register 68 serially shifts synchronized MILES code pulses through 352 bits at a 96 kHz rate. The shift register has 11 outputs that are spaced 32 bits apart to correspond to the bit spacing in a MILES code word of 333.3 $\mu$sec. When a MILES code word is detected, the MILES word is latched and the processor 58 reads and evaluates the 11-bit word. Detecting a MILES code word also starts the BINS counter logic circuit 70, so that BINS 6, 8 and 10 of the MILES word can also be processed.

When a complete MILES word is shifted into the shift register 68, the first three bits (1 1 0) of the word are detect by a MILES code detector 72. The MILES code detector then generates an output pulse to reset the BINS counter logic circuit 70, latch the MILES word and interrupt the processor 58 so that it can read the latched MILES word.

An up/down noise counter 74 counts up whenever a MILES code word pulse enters the shift register 68 and counts down whenever a pulse is shifted out. When a complete MILES word has been shifted into the shift register, if there is no noise the count in the up/down noise counter is 10, since a MILES word with weapon and PID information includes 10 bits. However, because of electromagnetic interference (EMI) or other noise sources, the up/down noise counter can have a count greater than 10.

Therefore, the processor can set a noise threshold, so that if the noise count is above the threshold, the MILES word will not be processed.

When the 96 kHz oscillator 66 is enabled, the BINS counter logic circuit 70 is constantly counting. This count is reset to zero when the MILES code detector 72 is activated. Since there are 32 shift register bits and 16 bins in each MILES code bit, it takes a count of 2 for each BIN shifting. Therefore, when the BINS counter logic circuit reaches counts of 12, 16 and 20, the shift register 68 is latched for bins 6, 8 and 10 of the MILES word. These BIN outputs are also coupled to the processor 58, so that it will know that the latched BINS are ready for reading and processing.

The TTH uses voice and sound effects to let the user know what events are happening in real time. When an event occurs, the processor 58 evaluates the event and sets the control and address lines of a voice/sound logic circuit 76 to activate an appropriate voice or sound effect. The voice and sound effects are stored in specific address locations on the voice/sound logic circuit, so that they can be accessed individually. The voice and sound effects are amplified before being output to speakers 78. The voice/sound logic circuit also includes circuitry for volume adjustment and a power-down mode for power conservation when inactive. Some of the events that can activate a voice or sound effect include: power on, user switches pressed, kill or near miss, low battery, weapon enabled/disabled, etc.

The GPS consumes considerable energy. Therefore, to conserve battery power by powering down the GPS when the "owner" of the TTH is not moving, the decoder includes a motion sensor 80, which generates a signal when the user wearing the TTH is walking or running. This signal is used to activate the processor 58 from a power-down mode and to let the processor know that the user is moving. The processor will then use this information to turn on the GPS and get new position information.

A GPS antenna 82 detects signals from GPS satellites and sends these signals to a GPS receiver 84 for processing. The GPS receiver processes these signals and generates position information, which is serially transmitted to the processor 58. The GPS receiver is equipped with a second serial channel to receive differential corrections from an optional differential receiver. Differential corrections may be necessary because the position information received from GPS satellites is frequently and intentionally degraded by the use of selective availability. Since the GPS receiver consumes the most power of any device in the decoder system, it is normally turned off. Controlling GPS receiver power is necessary for extended battery operation. Thus, the GPS receiver is only turned on after the processor receives from the motion sensor 80 a signal representative of the user taking a predefined number of steps, and is then immediately turned off after the processor receives new GPS position information.

The TTH is equipped with a serial debug channel that can be connected directly to the RS-232 port of a PC The decoder therefore includes a debug logic circuit 86, the purpose of which is to convert the RS-232 signals from the PC into TTL signals that can be received and processed by the processor 58. The debug channel is necessary in order to run the system directly from a PC for the purpose of software debugging.

An infrared light emitting diode (IR LED) of an infrared transmit (IR TX) logic circuit 87 is used to communicate with existing weapons that use an optical link The processor 58 serially transmits information using its serial channel 0 for serial data and timer 0 for reducing the width of serial data pulses. The detectors/amplifier 52 is used as the receiving end of this optical communications channel.

An RF transmitter 88 in the TTH is used to respond to messages by the FM SAT. Whenever a request for "weapon enable" or a "hello" message is received, the processor 58 generates a response and sends it to the RF transmitter serially. The message flows serially from the RF transmitter to a TX antenna 90, from which it is radiated into the atmosphere to initiate communications with the FM SAT. The RF transmitter operates at the same frequency as the RF receiver 46 of the SAT. The RF transmitter is also used to transmit data to a PC for after action review (AAR).

An RF receiver 92 obtains signals from an RX antenna 94, which in turn receives RF signals from the atmosphere. The RF receiver transmits those signals serially to the processor 58 for evaluation. The RF receiver operates at the same frequency as the SAT's RF transmitter 42. Messages from a PC or FM SAT are received and processed and a response is generated to send out through the RF transmitter.

A receiver power logic circuit 96 controls the power consumption of the RF receiver 92. To conserve battery power, the RF receiver is turned on only for brief periods to look for PC or SAT RF messages. The RF receiver stays powered-up continuously as long as a message is being received. When the receiver power logic circuit detects that a message no longer is being received, power to the RF receiver goes back to being enabled for only brief periods.

The TX and RX antennas 90 and 94 are used to transmit and receive RF data. RF communications between the SAT and TTH take place in a very short range, since the same soldier who wears the TTH also carries the weapon to which the SAT is attached, so the antennas do not have to be high quality. For this reason, these short-range antennas are conveniently and economically printed directly on the decoder circuit board.

A serial 0 select logic circuit 98 is used to multiplex two serial channels into one. This is necessary since the processor 58 only provides two serial channels. To select the data that will be transmitted or received, the processor sends a select signal to the serial 0 select logic circuit, which then receives the selected serial channel. The serial 0 select logic circuit is used to select between the IR and RF serial channels. A serial 1 select logic circuit 99 is used to select between the GPS and debug serial channels.

Whenever a switch (not shown) on the TTH is pressed, the NMI logic circuit 62 generates a pulse to awaken the processor 58 from its power-down state. Another interrupt is generated by a switch controls logic circuit 100 to let the processor know that a switch has been pressed. The processor will then generate a signal to latch the switch data and process the switch that was pressed. Switches on the TTH that are available for use include: (1) an "events" switch, used to replay events starting from the last one; (2) a "volume" switch, used to adjust the volume of the speakers; (3) a "bit" switch, used to perform a built-in test, and (4) a "spare" switch, used to enable existing SAT'S.

A power logic circuit 102 incorporates a comparator used for low battery detection and a dc-dc converter used to generate two different voltages and a shutdown signal (SHDN). Low battery signals are generated when the voltage of the battery 51 falls below a specific threshold. The low battery signal is processed when a switch is pressed and a voice event is generated to let the user know that battery power is low. The dc-dc converter uses battery power to generate the VCC voltage for the decoder system and the higher voltage required for the detectors/ amplifier 52. The shutdown signal generated by the dc-dc converter is used to detect when battery power is lost, by switching the power off or removing the batteries. Because of the high speed of the decoder system 50, a shutdown event can be processed and recorded before power is completely lost.

A VCC monitor 104 detects when the VCC supply voltage declines below a preset threshold. When this occurs, a reset signal is and continues to be asserted for at least 140 msec. after VCC has again risen above the preset threshold. This signal is used as a reset for the processor 58 and is usually applied at power-on to allow system power (VCC) to be fully charged.

The processor 58 is clocked by a 24.576 MHz oscillator and is normally in a power-down state to conserve battery power. To activate the processor, the NMI logic circuit 62 receives signals from various sources in the system and generates an NMI signal that is sent directly to the processor's NMI input. Another signal is normally generated to let the processor know what it was awakened by. The various sources used to generate an NMI signal include the motion sensor 80, the switch controls logic circuit 100, the power logic circuit 102 (in a shutdown event), the integrated laser pulses logic circuit 60 and the RF receiver 92.

The invention therefore provides an improved laser based tactical engagement simulation training system. The system provides for the transmission of additional information by a laser signal, by embedding the additional information in an existing MILES code structure. The invention provides enhanced MILES system features, while maintaining downward compatibility with existing MILES systems.

While one embodiment of the invention has been described in detail, various modifications and other embodiments thereof can be devised by one skilled in the art without departing from the spirit and scope of the invention, as defined in the accompanying claims.

What is claimed is:

1. A method of generating an improved code word for a laser based tactical engagement simulation training system of a type in which a standard code word for the system has a predetermined fixed duration and consists of a plurality of bits of logic levels "1" and "0" that occur at fixed intervals and at selected positions in the code word, comprising the steps of providing a standard code word; and FM modulating to selected frequencies only individual logic level "1" bits of the standard code word, such that the improved code word has the same fixed duration as the standard code word, the FM modulated bits of selected frequencies occur in place of and in the same selected positions as the logic level "1" bits of the standard code word, and unmodulated bits of logic level "0" occur in the remaining bit positions.

2. A method as in claim 1, including the step of assigning to each selected frequency a value unique to it.

3. A method as in claim 1, wherein said FM modulating step modulates a logic level "1" bit at a predetermined position in the standard code word to have a frequency indicative of information conveyed by the remaining FM modulated bits of the same standard code word.

4. A method as in claim 1, wherein said step of FM modulating causes at least two pulses at a selected frequency to occur during the same fixed interval as does the modulated logic "1" bit.

5. A method as in claim 4, including the step of controlling said FM modulating step such that the frequency to which logic "1" bits are modulated is according to the formula $f=1/t$, where t is the time interval between leading edges of two successive pulses of individual ones of the FM modulated bits.

6. A method of generating an improved MILES code word for a laser based tactical engagement simulation training system of a type in which a standard code word for the system has a predetermined fixed duration and consists of a plurality of bits of logic levels "1" and "0" that occur at fixed intervals and at selected positions in the code word to convey standard required information, with the remainder of the bits being logic level "0", comprising the step of modifying individual ones of only the logic level "1" bits of a standard MILES code word to contain information in addition to the standard required information, said modifying step being performed such that the modified code word has the same fixed duration as the standard code word, the modified logic level "1" bits occur in place of and at the same selected bit positions as do and are of the same fixed duration as the logic level "1" bits of the standard code work, and unmodified bits of logic level "0" are in the remaining bit positions.

7. A method as in claim 6, wherein said modifying step comprises the step of embedding into individual ones of the logic level "1" bits of the standard MILES code word information in addition to the information required to be contained in the standard MILES code word.

8. A method as in claim 6, wherein said modifying step comprises the step of FM modulating individual ones of the logic level "1" bits of the standard MILES code word to contain information in addition to the information required to be contained in the standard MILES code word.

9. A method as in claim 8, wherein said FM modulating step comprises modulating the logic level "1" bits to have selected frequencies.

10. A method as in claim 9, including the step of assigning to each selected frequency a value unique to it.

11. A method as in claim 9, wherein said FM modulating step modulates a logic level "1" bit in a predetermined bit position in the standard code word to have a frequency indicative of information conveyed by the remaining FM modulated bits of the same code word.

12. A method as in claim 9, wherein said step of FM modulating a logic "1" bit causes at least two pulses at a selected frequency to occur during the same time frame as the logic "1" bit.

13. A method as in claim 12, including the step of controlling said FM modulating step such that the frequency to which logic "1" bits are modulated is according to the formula $f=1/t$, where t is the time interval between leading edges of two successive pulses of individual ones of the FM modulated bits.

14. A method of operating a MILES system, comprising the steps of generating a code word having a standard MILES code word structure in which the code word has a predetermined fixed duration and consists of a predetermined number of bits of logic level "1" in bit positions selected to convey standard required information, and in which the remaining bits are logic level "0" and the logic levels "1" and "0" bits occur at fixed intervals modifying individual ones of only the logic level "1" bits of the standard MILES code word to contain information in addition to the standard required information, said modifying step being performed such that the modified code word has the same fixed duration as the standard code word, the modified logic level "1" bits occur in place of and at the same selected bit positions as do and are of the same fixed interval as are the logic level "1" bits of the standard code work, and unmodified bits of logic level "0" are in the remaining bit positions; and controlling operation of a laser in response to the modified code word to generate and transmit a pulsed laser signal representative of the modified code word.

15. A method as in claim 14, wherein said modifying step comprises the step of embedding the additional information into individual ones of the logic level "1" bits of the standard MILES code word.

16. A method as in claim 14, wherein said modifying step comprises the step of FM modulating individual ones of the logic level "1" bits of the standard MILES code word to contain the additional information.

17. A method as in claim 16, wherein each FM modulated logic level "1" bit comprises at least two pulses at a selected frequency and occurring during the same fixed interval as the original logic "1" bit.

18. A method as in claim 17, including the step of controlling said FM modulating step such that the frequency of each FM modulated bit is determined according to the formula f=1/t, where t is the time interval between leading edges of two successive pulses of the FM modulated bit.

19. A method as in claim 14, including the step of receiving and decoding the pulsed laser signal to obtain therefrom at least the standard required information contained in the modified code word.

20. An improved MILES system as in claim 19, wherein said step of receiving and decoding the pulsed laser signal obtains therefrom both the standard required information and the additional information.

21. A method as in claim 14, including the step of modifying a predetermined one of the logic "1" bits to contain information identifying the nature of the information conveyed by the remaining modified logic "1" bits of the same code word.

22. A method as in claim 21, wherein said step of modifying a predetermined one of the logic "1" bits modifies the first logic "1" bit of the code word.

23. A method as in claim 14, wherein said step of controlling operation of the laser includes operating a laser driver to provides constant power or energy to the laser for each modified logic "1" bit to be output by the laser.

24. A method of generating an improved code word for a MILES system in which a standard code word of the system has a predetermined fixed duration and consists of a plurality of bits of logic levels "1" and "0" that occur at fixed intervals and at selected positions in the code word, comprising the steps of generating a code word having the same number of bits and the same predetermined fixed duration and in which the bits occur at the same fixed intervals as in the standard code word; FM modulating to selected frequencies only those bits of the code word that are in the same bit positions as are logic level "1" bits of the standard code word; and providing bits of logic level "0" at bit positions not occupied by FM modified bits, such that the improved code word has the same fixed duration as the standard code word, the FM modulated bits of selected frequencies occur in the same selected bit positions as do the logic level "1" bits of the standard code word, and unmodulated bits of logic level "0" occur in the remaining bit positions.

25. A method of generating an improved code word for a MILES system of a type in which a standard code word for the system has a predetermined fixed duration and consists of a plurality of bits of logic levels "1" and "0" that occur at fixed intervals and at selected positions in the code word to convey standard required information, comprising the steps of generating a code word having the same number of bits as in and the same predetermined fixed duration as and in which the bits occur at the same fixed intervals as do the bits in the standard code word; modifying individual ones of only those bits that occur in the same bit positions as do logic level "1" bits of a standard code word to add to the bits information in addition to the standard required information, said modifying step being performed such that the improved code word has the same fixed duration as the standard code word, the modified bits occur in the same selected bit positions as do are of the same fixed duration as are the logic level "1" bits of the standard code work, and unmodified bits of logic level "0" are in the remaining bit positions.

26. A method of operating a MILES system, comprising the steps of providing an improved MILES code word for a laser based tactical engagement simulation training system of a type in which a standard code word for the system has a predetermined fixed duration and consists of a plurality of bits of logic levels "1" and "0" that occur at fixed intervals and at selected positions in the code word to contain standard required information, said providing step comprising the steps of generating a code word having the same number of bits as and the same predetermined fixed duration as and in which the bits occur at the same fixed intervals as in the standard code word, and modifying individual ones of only those bits that occur in the same bit positions as do the logic level "1" bits of a standard MILES code word to add to the bits information in addition to the standard required information, said modifying step being performed such that the modified code word has the same fixed interval as the standard code word, the modified bits occur in place of and at the same selected bit positions as do and are of the same fixed duration as are the logic level "1" bits of the standard code work, and unmodified bits of logic level "0" are in the remaining bit positions; and controlling operation of a laser in response to the modified code word to generate and transmit a pulsed laser signal representative of the modified code word.

* * * * *